US010333215B2

(12) United States Patent
Suzuki et al.

(10) Patent No.: US 10,333,215 B2
(45) Date of Patent: Jun. 25, 2019

(54) MULTI-BAND ARRAY ANTENNA

(71) Applicant: NTT DOCOMO, INC., Chiyoda-ku (JP)

(72) Inventors: Yasunori Suzuki, Chiyoda-ku (JP); Makoto Sumi, Chiyoda-ku (JP); Takashi Hosozawa, Chiyoda-ku (JP)

(73) Assignee: NTT DOCOMO, INC., Chiyoda-ku (JP)

( * ) Notice: Subject to any disclaimer, the term of this patent is extended or adjusted under 35 U.S.C. 154(b) by 109 days.

(21) Appl. No.: 15/570,516

(22) PCT Filed: Apr. 22, 2016

(86) PCT No.: PCT/JP2016/062780
§ 371 (c)(1),
(2) Date: Oct. 30, 2017

(87) PCT Pub. No.: WO2016/181793
PCT Pub. Date: Nov. 17, 2016

(65) Prior Publication Data

US 2018/0159215 A1 Jun. 7, 2018

(30) Foreign Application Priority Data

May 14, 2015 (JP) ..... 2015-098753

(51) Int. Cl.
*H01Q 21/30* (2006.01)
*H01Q 1/52* (2006.01)
(Continued)

(52) U.S. Cl.
CPC ..... *H01Q 1/523* (2013.01); *H01P 5/12* (2013.01); *H01Q 5/371* (2015.01); *H01Q 5/42* (2015.01);
(Continued)

(58) Field of Classification Search
CPC .. H01Q 5/42; H01Q 5/35; H01Q 5/50; H01Q 5/48; H01Q 21/30; H01Q 21/062; H01Q 21/08; H03H 2007/386
See application file for complete search history.

(56) References Cited

U.S. PATENT DOCUMENTS 6,208,299 B1 * 3/2001 Lindmark ..... H01Q 21/08 343/700 MS
7,486,955 B2 * 2/2009 Fukushima ..... G06F 1/1616 455/452.1
(Continued)

FOREIGN PATENT DOCUMENTS

JP 2005-33517 A 2/2005
JP 2009-253959 A 10/2009
(Continued)

OTHER PUBLICATIONS

International Search Report dated Jun. 7, 2016 in PCT/JP2016/062780 filed Apr. 22, 2016.
(Continued)

*Primary Examiner* — Dameon E Levi
*Assistant Examiner* — Ab Salam Alkassim, Jr.
(74) *Attorney, Agent, or Firm* — Oblon, McClelland, Maier & Neustadt, L.L.P.

(57) ABSTRACT

A multi-band array antenna comprises m first antenna elements operating in p frequency bands; n second antenna elements operating in q frequency bands; a Wilkinson power distributor; one or more filters; and one or more matching circuits. Here, m and n are positive integers satisfying m+n≥3 and any of m=n+1, n=m+1 and m=n; and p and q are positive integers satisfying p≥1, q≥2 and q>p. The m first antenna elements and the n second antenna elements are alternately arranged. The matching circuit performs impedance matching between the filter and the Wilkinson power distributor in a frequency band attenuated by the filter. A
(Continued)

series-connection circuit portion is configured so that a branch portion of the power distributor becomes an open end in the attenuation frequency band.

2 Claims, 12 Drawing Sheets

(51) Int. Cl.

| | |
|---|---|
| ***H01Q 9/04*** | (2006.01) |
| ***H01P 5/12*** | (2006.01) |
| ***H01Q 9/28*** | (2006.01) |
| ***H01Q 21/06*** | (2006.01) |
| ***H01Q 5/371*** | (2015.01) |
| ***H01Q 5/42*** | (2015.01) |
| ***H01Q 5/50*** | (2015.01) |
| *H01Q 21/08* | (2006.01) |

(52) U.S. Cl.
CPC ..... *H01Q 5/50* (2015.01); *H01Q 9/0435* (2013.01); *H01Q 9/285* (2013.01); *H01Q 21/062* (2013.01); *H01Q 21/30* (2013.01); *H01Q 21/08* (2013.01)

(56) References Cited

U.S. PATENT DOCUMENTS 7,755,559 B2 * 7/2010 Pakosz ..... H01Q 9/285 343/700 MS
8,849,217 B2 * 9/2014 Rousu ..... H01Q 3/2605 370/328
9,277,590 B2 * 3/2016 Kokkinos ..... H01Q 1/246
10,020,595 B2 * 7/2018 Mortazawi ..... H03F 3/24
2005/0170862 A1 * 8/2005 Fukushima ..... G06F 1/1616 455/556.1
2010/0141545 A1 * 6/2010 Pakosz ..... H01Q 9/285 343/810
2012/0196545 A1 * 8/2012 Schmidt ..... H01Q 1/246 455/73
2012/0329407 A1 * 12/2012 Rousu ..... H01Q 3/2605 455/90.2
2014/0036777 A1 * 2/2014 Kokkinos ..... H01Q 1/246 370/328
2015/0065151 A1 * 3/2015 Baliarda ..... H01Q 1/246 455/446
2015/0318622 A1 * 11/2015 Pruett ..... H01Q 21/061 343/876
2016/0093958 A1 * 3/2016 Mortazawi ..... H03F 3/24 330/144

FOREIGN PATENT DOCUMENTS

JP 2013-207522 A 10/2013
JP 2014-511593 A 5/2014
WO WO 2012/107176 A1 8/2012

OTHER PUBLICATIONS

"Ubiquitous Module Antenna (rooftop antenna 02)" NTT Docomo, Inc., [URL: http://www.docomo.biz/img/module/pdf/members/option/manual_rt-ant_02.pdf], Retrieved on Apr. 21, 2016, 3 Pages (with partial English language translation).

* cited by examiner

MULTI-BAND ARRAY ANTENNA

TECHNICAL FIELD

The present invention relates to a multi-band array antenna that can be mounted on a construction machine, a vehicle, a vending machine and the like.

BACKGROUND ART

Progress in mobile communications is not limited to consumer usage fields using voice or data transmission, represented by smartphones and tablets, but extends to a telemetry field that has been constructed as a dedicated system. Recently, usage of M2M (Machine to Machine) using an inexpensive and small-size wireless module is progressing. Unlike consumer usage traffic, periodical traffic with a small amount of information occurs in M2M.

A wireless module for M2M (hereinafter also referred to simply as a wireless module) is configured with a wireless transceiver and an external antenna. For example, a wireless transceiver designed to properly operate in a 2 GHz band and an 800 MHz band and an externally installed loop antenna having both of the 2 GHz band and the 800 MHz band as operating frequency bands are known. The wireless transceiver is, for example, built into a handy terminal or a vending machine. The external antenna is connected to an antenna terminal of the wireless transceiver and is installed, for example, as an antenna of a handy terminal or on the top of a vending machine. In general, in the wireless module, it is not necessary to integrally install the wireless transceiver and the external antenna. Thus, unlike smartphones, tablets or mobile phones for consumers, the wireless module has an implementation form with a high degree of freedom.

As the external antenna, various products are provided (for example, see Non patent document 1). The above loop antenna having both of the 2 GHz band and the 800 MHz band as operating frequencies has the following specifications: outer diameter: 150 mm×40 mm×60 mm; 2 GHz band gain: −8 dBd or more; 800 MHz band gain: −7 dBd or more; and weight: 220 g. Further, such an antenna is also known that a printed-circuit board on which an antenna pattern is printed is built into a plastic housing, and its electrical characteristics are almost similar to those of a loop antenna.

As an example of a conventional wireless module for M2M, an example of operating in both of the 2 GHz band and the 800 MHz band as described above is known. Due to increase in the number of frequency bands for mobile phones, it is thought that the number of frequency bands that can be used in a wireless module also increases. From the viewpoint of characteristics of a wireless module, frequency bands used for wireless communication are not necessarily required to be frequency bands for mobile phones, and furthermore use of various frequency bands, such as frequency bands used by specified low-power equipment, frequency bands for RFID and the like and frequencies bands for wireless LAN, is conceivable though there are preconditions to meet certain technical standards.

PRIOR ART LITERATURE

Non-Patent Literature

Non-patent literature 1: NTT DOCOMO, INC., Ubiquitous Module Antenna (rooftop antenna 02), [online], [retrieved on Apr. 21, 2016], the Internet <URL: http://www-.docomo.biz/img/module/pdf/members/option/manual_rt-ant_02.pdf>

SUMMARY OF THE INVENTION

Problem to be Solved by the Invention

As an antenna for wireless module for M2M, a configuration of antenna elements operating in a plurality of frequency bands (hereinafter referred to as multi-band antenna elements) is desired. Though use of a broadband antenna that covers all operating frequency bands is possible, sufficient gain cannot be obtained by a general broadband antenna. Further, a broadband antenna also receives signals of frequency bands that are not used.

As a method for improving gain of an antenna, a method is known in which a plurality of antenna elements are arranged to configure an array antenna. In order to realize a high-gain antenna operating in a plurality of frequency bands, the array antenna can be configured with multi-band antenna elements.

In a wireless transceiver of a wireless module, signals of a plurality of frequency bands are inputted to one connector. Therefore, it is necessary that the number of input terminals is one regardless of the number of operating frequency bands. Therefore, in the case of configuring an array antenna using a plurality of multi-band antenna elements, a distribution circuit is used.

If a lot of operating frequency bands are set in such an array antenna, it is difficult to optimize spacing between adjacent multi-band antenna elements. Further, since a general distribution circuit equally distributes power, it is common that all the multi-band antenna elements connected to the distribution circuit have the same configuration.

An object of the present invention is to provide a multi-band array antenna that makes it possible to optimize spacing between adjacent multi-band antenna elements and is capable of proper power distribution by a distribution circuit.

Means to Solve the Problems

A multi-band array antenna of the present invention comprises: m first antenna elements each operating in p frequency bands; n second antenna elements each operating in q frequency bands; one Wilkinson power distributor having one input terminal and m+n output terminals; one or more filters; and one or more matching circuits. Here, m and n are positive integers satisfying $m+n \geq 3$ and any of $m=n+1$, $n=m+1$ and $m=n$; and p and q are positive integers satisfying $p \geq 1$, $q \geq 2$ and $q>p$. Here, the p frequency bands are included in the q frequency bands; the number of the one or more filters is m; and the number of the one or more matching circuits is m. The m first antenna elements and the n second antenna elements are alternately arranged. Each of the n second antenna element is connected to a corresponding one of n output terminals among the m+n output terminals of the Wilkinson power distributor, and each of the m first antenna element is connected to a corresponding one of m output terminals among the m+n output terminals of the Wilkinson power distributor via a series-connection circuit portion comprising a corresponding one of the in matching circuit and a corresponding one of the m filter. Each filter attenuates a frequency band that is included in the q frequency bands but is not included in the p frequency bands, and each matching circuit performs impedance matching between a filter to which the matching circuit is connected and the Wilkinson power distributor in a frequency band attenuated by the filter. Each series-connection circuit portion is configured so that a branch portion of the Wilkinson power distributor becomes an open end in a frequency band attenuated by a filter comprised in the series-connection circuit portion.

It is favorable that a distance between adjacent first and second elements is between 0.6 wavelengths and 1 wavelength including the 0.6 wavelengths and excluding the 1 wavelength, in each of the q frequency bands.

Effects of the Invention

According to the present invention, m first antenna elements and n second antenna elements are alternately arranged; each matching circuit performs impedance matching between a filter and a Wilkinson power distributor in a frequency band attenuated by the filter; and each series-connection circuit portion is configured so that a branch portion of the Wilkinson power distributor becomes an open end in a frequency band attenuated by its filter. Therefore, it is possible to optimize spacing between adjacent multi-band antenna elements, and it is also possible to perform proper power distribution by a distribution circuit.

DETAILED DESCRIPTION OF THE EMBODIMENTS

Figure 1:
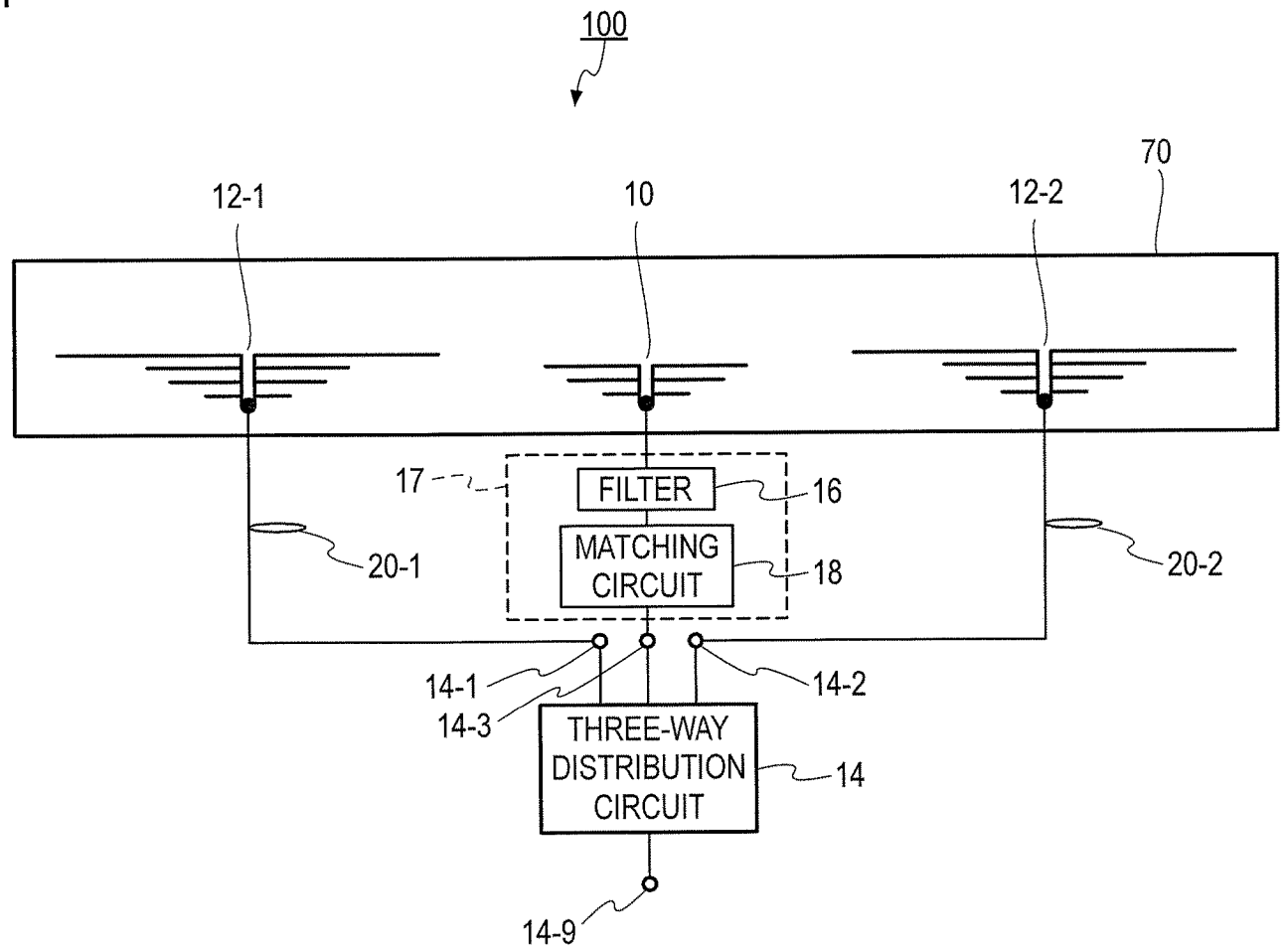
FIG. 1 shows a configuration of a first embodiment.

Embodiments of the present invention will be described with reference to drawings. Hereinafter, in each embodiment, the same reference numerals will be assigned to common components, and duplicated description will be omitted.

As already described, if a lot of operating frequency bands are set in an array antenna configured with a plurality of multi-band antenna elements (hereinafter referred to as a multi-band array antenna), it is difficult to optimize spacing between adjacent multi-band antenna elements.

There is an optimum value of spacing between antenna elements constituting an array antenna, for each frequency band. When an antenna element alone operates in a plurality of frequency bands, spacing between antenna elements is not optimum in all the operating frequency bands. Therefore, gain of the array antenna is not so high as expected. For example, in the case of configuring an array antenna with dual-band antenna elements that operate in the 2 GHz band and the 800 MHz band at the same time, spacing that is optimum in the 2 GHz band is not optimum spacing in the 800 MHz band. Similarly, spacing that is optimum in the 800 MHz band is not optimum spacing in the 2 GHz band.

Therefore, in the present invention, two kinds of multi-band antenna elements are used to configure a multi-band array antenna. Each of one or more operating frequency bands of one multi-band antenna element is equal to any one of operating frequency bands of the other multi-band antenna element and at least one of the operating frequency bands of the other multi-band antenna element is not equal to any of the one or more operating frequency bands of the one multi-band antenna element.

When a set of operating frequency bands of one multi-band antenna element overlaps with part of a set of operating frequency bands of the other multi-band antenna element as described above, a configuration is conceivable in which a filter that causes only an operating frequency band among outputs of a distribution circuit to pass through is connected to an output terminal of the distribution circuit. However, since the distribution circuit equally distributes power according to the number of output terminals, a frequency component for which the multi-band antenna element does not operate is reflected by the filter and absorbed by resistance inside the distribution circuit. Therefore, as for this frequency component, loss by the distribution circuit is assumed to increase. For example, when two antenna elements among three antenna elements constituting a multi-band array antenna are configured to operate in the 800 MHz band and the 2 GHz band, and the remaining one antenna element is configured to operate in the 2 GHz band, the level of power supply to the 800 MHz band decreases because power is distributed in trisection to the antenna elements by the distribution circuit though the power should be distributed in bisection to the antenna elements operating in the 800 MHz.

Therefore, in the present invention, in order to realize proper power distribution by a distribution circuit, a matching circuit is provided between each of part of output terminals of a Wilkinson power distributor and each filter corresponding to the part of output terminals, and, furthermore, the filter and the matching circuit are configured so that a branch portion of the Wilkinson power distributor becomes an open end in an attenuation frequency band of the filter.

From the above viewpoint, a multi-band array antenna of the embodiments of the present invention comprises m first antenna elements that operate in each of p frequency bands, n second antenna elements that operate in each of q frequency bands, one Wilkinson power distributor having one input terminal and m+n output terminals, one or more filters and one or more matching circuits.

Here, m and n are positive integers satisfying any of $m=n+1$, $n=m+1$ and $m=n$, and $m+n\geq 3$; and p and q are positive integers satisfying $p\geq 1$, $q\geq 2$, $q>p$.

The p frequency bands are included in the q frequency bands. Further, the number of filters is m, and the number of matching circuits is m.

The m first antenna elements and the n second antenna elements are alternately arranged, and one second antenna element is connected to each of n output terminals among the m+n output terminals of the Wilkinson power distributor. Further, one first antenna element is connected to each of m output terminals among the m+n output terminals of the Wilkinson power distributor via a series-connection circuit portion comprising one matching circuit and one filter.

Each filter attenuates a frequency band that is included in the q frequency bands but is not included in the p frequency bands. Each matching circuit performs impedance matching between a filter to which the matching circuit is connected and the Wilkinson power distributor in a frequency band attenuated by the filter. Each series-connection circuit portion is configured so that a branch portion of the Wilkinson power distributor becomes an open end in an attenuation frequency band of a filter comprised in the series-connection circuit portion.

Specific embodiments of the present invention will be described below.

First Embodiment

A multi-band array antenna 100 shown in FIG. 1 is in a configuration in the case of p=3, q=4, m=1 and n=2. That is, the multi-band array antenna 100 comprises one first antenna element 10 operating in each of three frequency bands, two second antenna elements 12-1 and 12-2 operating in each of four frequency bands, one Wilkinson power distributor 14 having one input terminal 14-9 and three output terminals 14-1, 14-2 and 14-3, one filter 16 and one matching circuit 18. A series-connection circuit portion 17 is configured with the filter 16 and a matching circuit 18.

The one first antenna element 10 and the two second antenna elements 12-1 and 12-2 are alternately arranged. One second antenna element 12-1 is connected to the first output terminal 14-1 among the three output terminals 14-1, 14-2 and 14-3 of the Wilkinson power distributor 14 via a delay circuit 20-1, and one second antenna element 12-2 is connected to the second output terminal 14-2 via a delay circuit 20-2. Further, the one first antenna element 10 is connected to the third output terminal 14-3 of the Wilkinson power distributor 14 via the series-connection circuit portion 17 comprising the one matching circuit 18 and the one filter 16. The delay circuits 20-1 and 20-2 give delay corresponding to delay by the series-connection circuit portion 17 comprising the one matching circuit 18 and the one filter 16, to signals.

The filter 16 attenuates a frequency band that is included in four frequency bands but is not included in three frequency bands. The matching circuit 18 performs impedance matching between the filter 16 to which the matching circuit 18 is connected and the Wilkinson power distributor 14 in the attenuation frequency band of the filter 16. The series-connection circuit portion comprising the matching circuit 18 and the filter 16 is configured so that a branch portion 14-8 of the Wilkinson power distributor 14 becomes an open end of a standing wave in the attenuation frequency band of the filter 16 comprised in this series-connection circuit portion.

Figure 2:
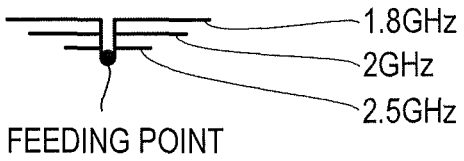
FIG. 2 shows a configuration example of a first antenna element.
Figure 3:
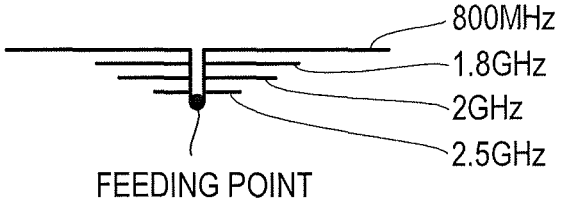
FIG. 3 shows a configuration example of a second antenna element.

FIG. 2 shows an example of the first antenna element and FIG. 3 shows an example of the second antenna element. The first antenna element is configured with a 1.8 GHz band dipole antenna element, a 2 GHz band dipole antenna element and a 2.5 GHz band dipole antenna element, and each dipole antenna element has a common feeding point. A feeder is connected to this feeding point. The second antenna element is configured with an 800 MHz band dipole antenna element, a 1.8 GHz band dipole antenna element, a 2 GHz band dipole antenna element and a 2.5 GHz band dipole antenna element, and each dipole antenna element has a common feeding point. A feeder is connected to this feeding point.

The first antenna element 10 and the second antenna elements 12-1 and 12-2 are formed as a film antenna. The thickness, length, width and relative permittivity of a film 70 are 0.1 mm, 35 cm, 3 cm and 2.7, respectively. The first antenna element 10 and the second antenna elements 12-1 and 12-2 are printed on the film 70 in electrically conductive ink. Spacing between the two second antenna elements 12-1 and 12-2 is 0.65 wavelengths at 850 MHz, and each of spacing between the first antenna element 10 and the second antenna element 12-1 and spacing between the first antenna element 10 and the second antenna element 12-2 is 0.70 wavelengths at 1.850 GHz.

In the case of configuring an array antenna by arranging a plurality of antenna elements, spacing between antenna elements has to be decided in consideration of a main beam and side lobes such as grating lobes. Generally, the more antenna elements an array antenna comprises, the more the gain of a main beam is improved, and the more the side lobes are reduced. On the contrary, in the case of an array antenna being configured with a small number of antenna elements, the level of side lobes becomes a more important problem than improvement of gain of a main beam.

Figure 4:
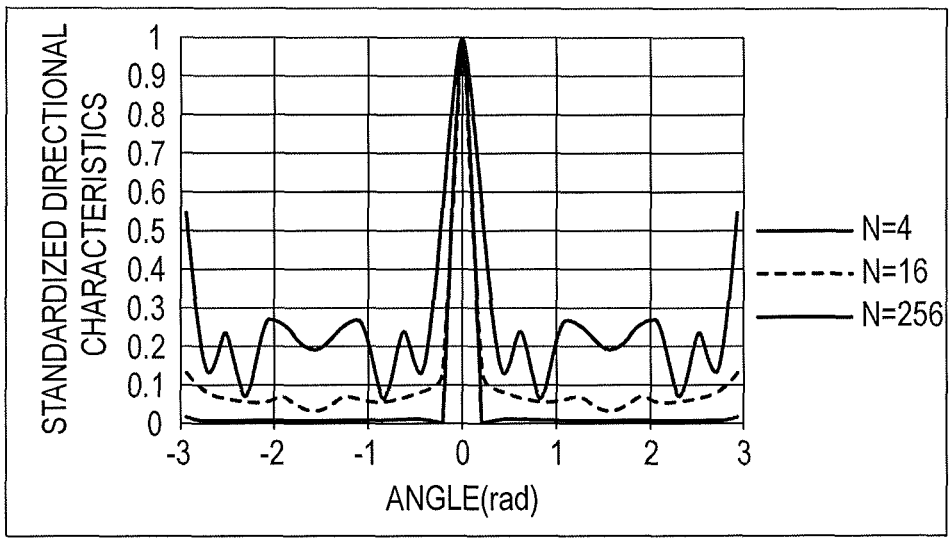
FIG. 4 shows directional characteristics of an array antenna according to the number of antenna elements.

FIG. 4 shows standardized directional characteristics in the cases where the number of antenna elements is four, sixteen and 256, respectively. In FIG. 4, in order to evaluate side lobes, especially grating lobes, gain thereof is standardized by gain of a main beam. As seen from FIG. 4, increase in the number of antenna elements can cause the level of side lobes to be sufficiently lower than the level of the main beam. In the case where the number of antenna elements is four, side lobes are seen in the vicinity of the angles of −1 rad, −2 rad, 1 rad and 2 rad. In the case of installing the multi-band array antenna of the present invention, for example, in a limited space on a construction machine, the number of antenna elements is limited. The realistic maximum number of antenna elements is thought to be five or six. Though it is understood from FIG. 4 that design in consideration of side lobes is necessary, arrangement of antenna elements in consideration of a side lobe level has not been decided because, in general, many antenna elements can be provided.

Figure 5:
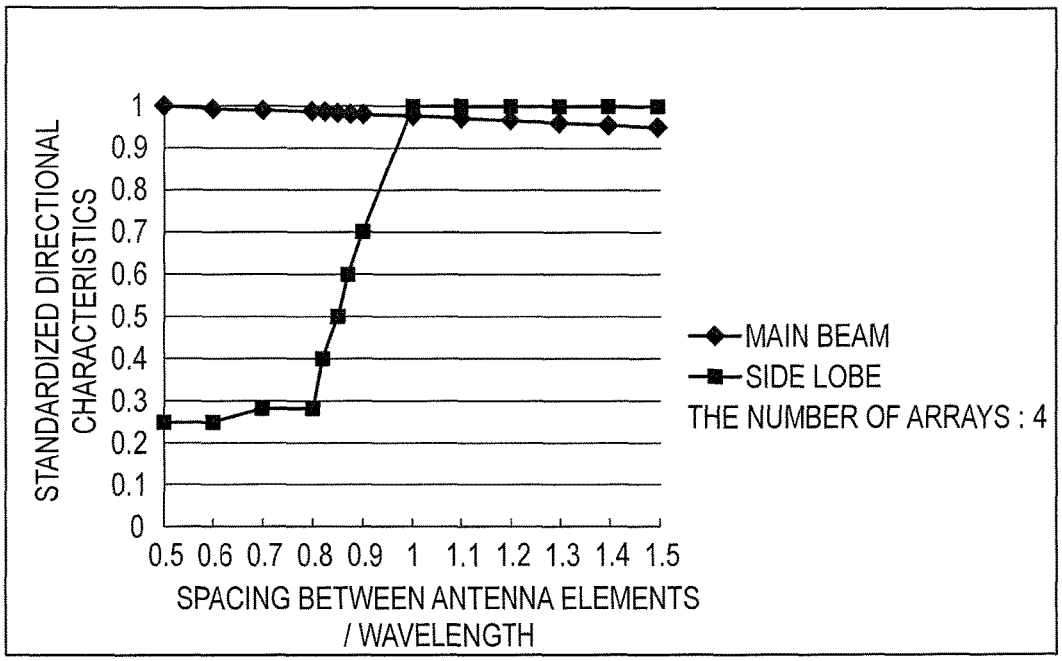
FIG. 5 is a diagram showing a relationship between antenna element spacing and antenna levels.

FIG. 5 shows a relationship between spacing between antenna elements in wavelength conversion and a level of a main beam and a relationship between spacing between antenna elements in wavelength conversion and a level of side lobe, in the case where the number of antenna elements is four. Though the level of the main beam decreases only by a few percent even when spacing between antenna elements in wavelength conversion is increased, the level of side lobes significantly increases when the spacing between antenna elements in wavelength conversion exceeds 0.9. From this result, in the multi-band array antenna of the present invention, the spacing between antenna elements in wavelength conversion has to be about 0.6 to 0.9 from the viewpoint of the level of side lobes and improvement in antenna gain by an array antenna configuration.

Since the 1.8 GHz band is about twice the 800 MHz band with regard to frequency, it is possible to, by arranging antenna elements with that ratio, configure an array antenna in which antenna elements covering the 800 MHz band as an operating frequency band and antenna elements not covering the 800 MHz band as an operating frequency band are alternately arranged.

Since the first antenna element is an antenna operating in each of the 1.8 GHz band, the 2 GHz band and the 2.5 GHz band, wavelength conversion distances in the frequency bands are different. Therefore, a condition for causing each of spacings between the first antenna element and the second antenna elements to be about 0.6 wavelengths to 0.9 wavelengths in the 1.8 GHz band, the 2 GHz band and the 2.5 GHz band is necessary. This is based on a relationship between each of the spacings between the first antenna element and the second antenna elements that are alternately arranged and wavelength conversion distances in the operating frequency bands.

Since the full length of the film antenna is 35 cm, spacing between the second antenna element 12-1 and the second antenna element 12-2 is set to 22.8 cm, which is 0.65 wavelengths at 850 MHz. Each of the spacings between the first antenna element 10 and the second antenna elements 12-1 and 12-2 is set to 11.4 cm, which is 0.70 wavelengths at 1.850 GHz. This antenna element spacing (11.4 cm) is due to 1.850 GHz being about 2.17 times 850 MHz as a frequency ratio. This antenna element spacing (11.4 cm) is 0.82 wavelengths at 2.150 GHz, and 0.93 wavelengths at 2.450 GHz. Both of the wavelengths are equal to or below approximately 0.9 wavelengths, and, therefore, the antenna element spacing is suitable as an antenna element spacing.

For example, the multi-band array antenna 100 is attached to be along a front pillar of a driver's seat of a construction machine. Therefore, the multi-band array antenna 100 is nondirectional on a horizontal plane. The multi-band array antenna 100 operates as a two-element array antenna in the 800 MHz band and operates as a three-element array antenna in the 1.8 GHz band, the 2 GHz band and the 2.5 GHz band. Therefore, improvement of directional gain by 3 dB or 4.7 dB is expected in an ideal state in comparison with a single dipole antenna.

Figure 6:
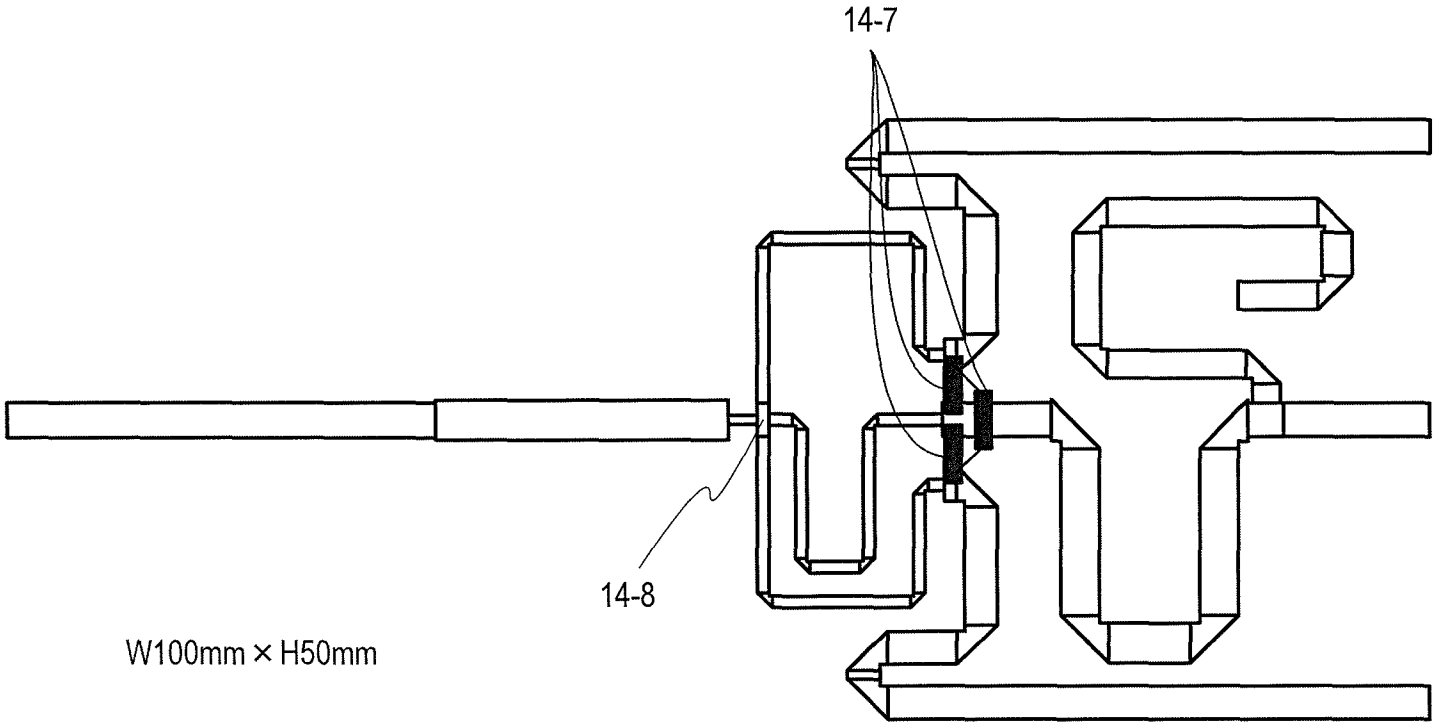
FIG. 6 shows an example of a three-way Wilkinson power distributor to which a series-connection circuit portion comprising one matching circuit and one filter, and two delay circuits are connected.

FIG. 6 shows a configuration of a three-way Wilkinson power distributor 14 to which the series-connection circuit portion 17 comprising the one matching circuit 18 and the one filter 16, and the delay circuits 20-1 and 20-2 are connected. Since a general wireless module has one transmitting/receiving terminal, a distribution circuit that functions at all operating frequencies of the wireless module is required. The Wilkinson power distributor 14 is a circuit that distributes input signals from a wireless module inputted to the input terminal 14-9 to each of the output terminals 14-1, 14-2 and 14-3 with equal power and equal delay. The filter 16 is a circuit that removes frequency components of the 800 MHz band and is, for example, a notch filter that attenuates the 800 MHz band. Since the notch filter is used, the delay circuits 20-1 and 20-2 are connected to the output terminals 14-1 and 14-2 to which the second antenna elements 12-1 and 12-2 are connected. The reason why the delay circuits 20-1 and 20-2 are used is to realize ideal directional characteristics by the first antenna element 10 and the second antenna elements 12-1 and 12-2.

Operation of the three-way Wilkinson power distributor 14 will be described. Signals of the four kinds of frequency bands, the 800 MHz band, the 1.8 GHz band, the 2 GHz band and the 2.5 GHz band, are inputted to the input terminal 14-9 of the Wilkinson power distributor 14. The signals distributed in trisection by the Wilkinson power distributor 14 are transmitted to the second antenna elements 12-1 and 12-2. Signals of the three kinds of frequency bands, the 1.8 GHz band, the 2 GHz band and the 2.5 GHz band other than the 800 MHz band removed by the filter 16, are transmitted to the first antenna element 10. The series-connection circuit portion 17 comprising the filter 16 and the matching circuit 18 defines a condition for the three-branch portion 14-8 of the Wilkinson power distributor 14 to be an open end at the 800 MHz band. That is, the open end condition is satisfied at the three-branch portion 14-8 by an electrical length from the three-branch portion 14-8 to the filter 16 via the matching circuit 18, and impedance matching in the 800 MHz band is performed by the matching circuit 18. The matching circuit 18 matches characteristic impedance Zn on the filter 16 side with characteristic impedance Zd when the input terminal 14-9 side is seen from a position where a resistor 14-7 of the Wilkinson power distributor 14 is added. The matching circuit 18 is realized, for example, by a ¼ wavelength line of characteristic impedance (Zn×Zd)^0.5. When seen from the input terminal 14-9 of the Wilkinson power distributor 14, the branch portion 14-8 of the Wilkinson power distributor 14 is an open end with respect to the side of the output terminal 14-3 to which the first antenna element 10 is connected, and a function of distributing in bisection input signals is realized, in the frequency band removed by the filter 16. In the frequency bands that are not removed by the filter 16, since the open end condition is not satisfied at the branch portion 14-8, characteristic impedance of each of the output terminals 14-1, 14-2 and 14-3 is seen, and a function of distributing in trisection input signals is realized. Thus, signal components of a frequency band to be distributed in bisection are distributed in bisection, and signal components of a frequency band to be distributed in trisection are distributed in trisection, so that optimum distribution is realized according to an operating frequency band of an antenna element.

As shown in FIG. 6, the three-way Wilkinson power distributor 14 to which the series-connection circuit portion 17 comprising the one matching circuit 18 and the one filter 16, and the delay circuits 20-1 and 20-2 are connected can be configured with a microstripline. Specifications of a printed-circuit board used are: relative permittivity: 2.2; dielectric thickness: 0.787 mm; double-sided copper clad; and copper thickness: 18 μm. The three-way Wilkinson power distributor 14 performs three-way distribution of input signals to ¼ wavelength lines with a characteristic impedance of 86.5Ω. Here, one wavelength is assumed to correspond to 1.65 GHz which is in the middle between 800 MHz and 2.5 GHz. As the resistors 14-7 included in the three-way Wilkinson power distributor 14, 100-Ω resistors are used. The series-connection circuit portion 17 comprising the filter 16 and the matching circuit 18 is configured with an impedance conversion circuit and an open-ended line. The impedance converter is used to match the impedance 50Ω of the output terminal 14-3 of the Wilkinson power distributor 14 with impedance on the open-ended line side. The delay circuits 20-1 and 20-2 are 50-Ω lines the line length of which has been adjusted to correspond to delay time of the filter 16. In the configuration shown in FIG. 6, each delay circuit can be configured with a line with a length of 10 cm and a width of 5 mm.

The filter 16 is not limited to a notch filter. In the first embodiment, since the 800 MHz band is attenuated, the filter 16 may be a high-pass filter. If the 2.5 GHz band is to be attenuated, the filter 16 may be a low-pass filter. Similarly, when the 1.8 GHz band is to be attenuated, the filter 16 may be a band-pass filter. A portion corresponding to the filter 16 may be configured with a coil and a capacitor.

Figure 7:
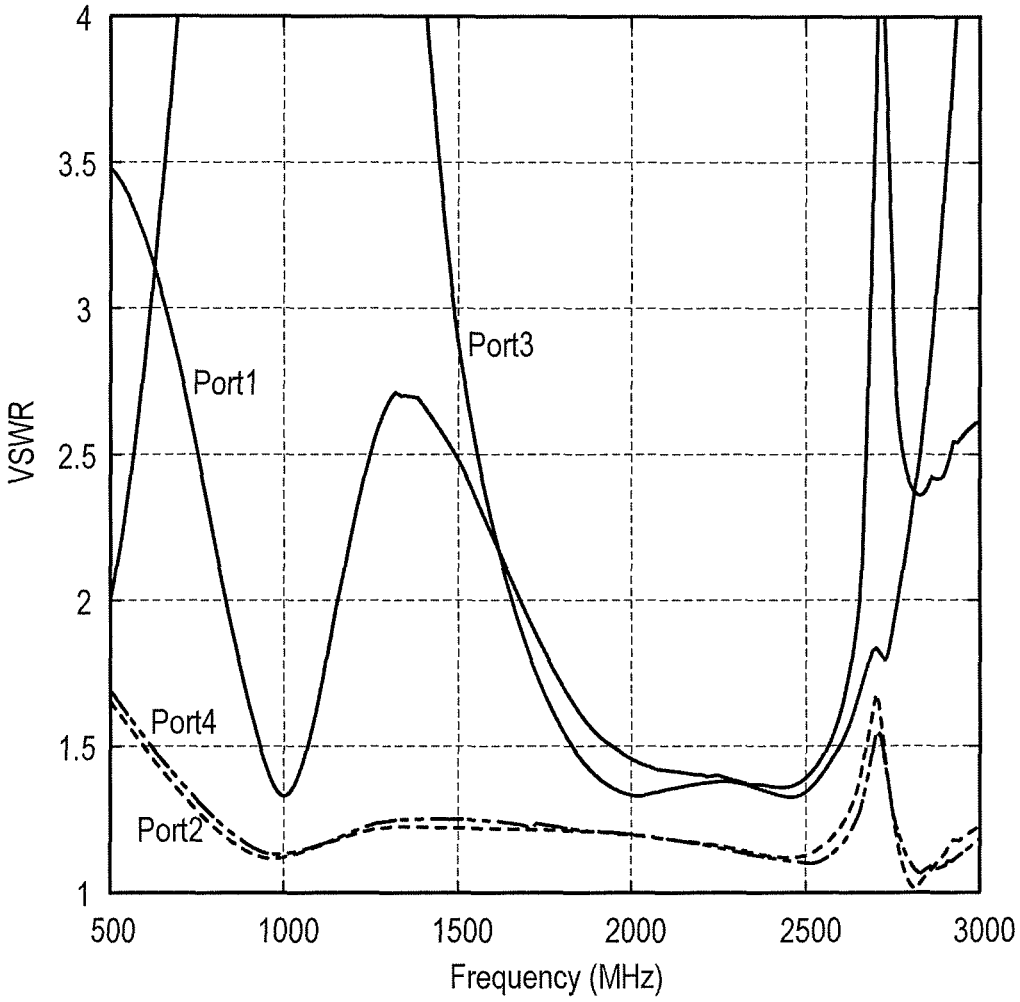
FIG. 7 shows VSWR characteristics of the circuit shown in FIG. 6.

FIG. 7 shows calculation results of VSWR characteristics of the three-way Wilkinson power distributor 14. Port 1, Port 2, Port 3 and Port 4 in FIG. 7 mean the input terminal 14-9, the output terminal 14-1 to the second antenna element 12-1, the output terminal 14-3 to the first antenna element 10 and the output terminal 14-2 to the second antenna element 12-2, respectively. It is seen that VSWR of 2 or less is achieved in the 800 MHz band and within a range from 1.8 GHz to 2.5 GHz.

Figure 8:
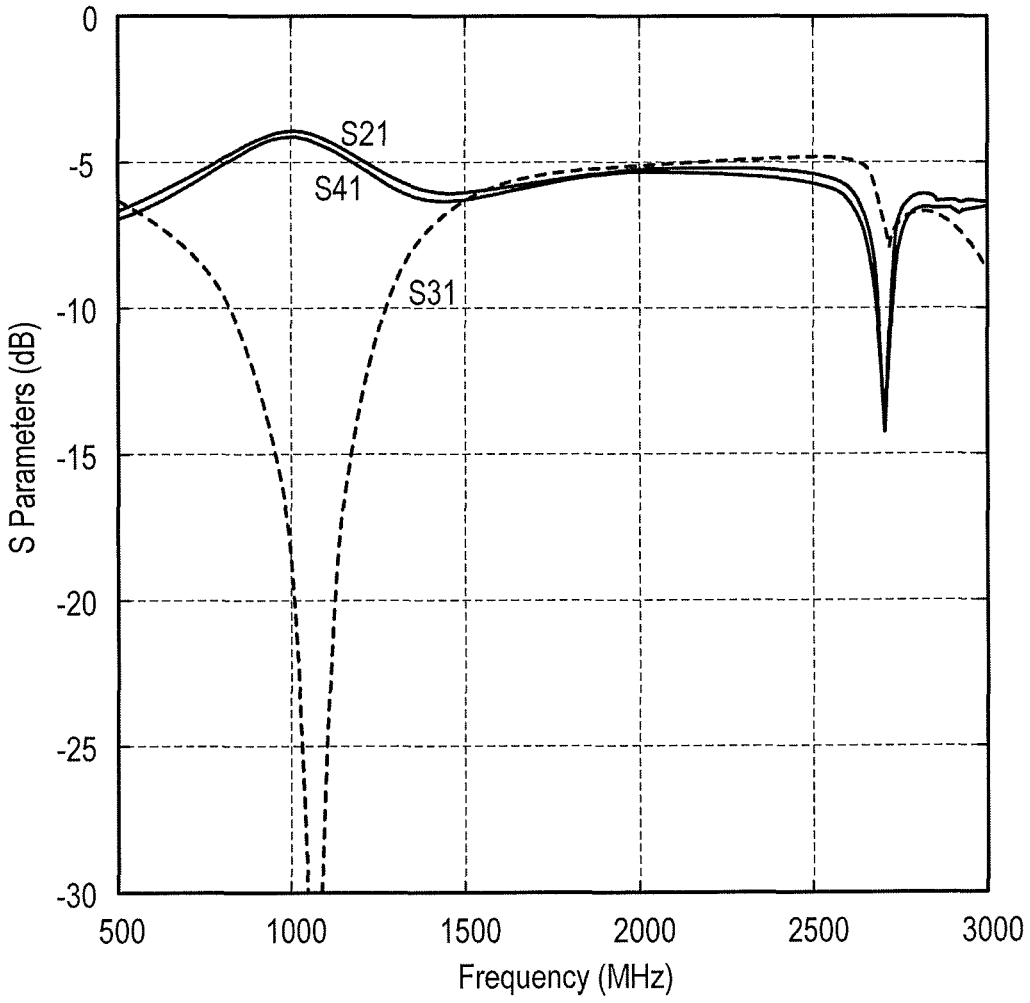
FIG. 8 shows frequency characteristics of the circuit shown in FIG. 6.

FIG. 8 shows frequency characteristics of the three-way Wilkinson power distributor 14. In FIG. 8, S21 indicates characteristics of pass from Port 1 to Port 2; S31 indicates characteristics of pass from Port 1 to Port 3; and S41 indicates characteristics of pass from Port 4 to Port 1. It is seen from S31 that, in distribution to the first antenna element 10, suppression by 10 dB or more is caused in the 800 MHz band, and the maximum insertion loss in from the 1.8 GHz band to the 2.5 GHz band is 5 dB. In comparison, in distribution to each of the second antenna elements 12-1 and 12-2, insertion loss of from the 800 MHz band to the 2.5 GHz band is approximately 5 dB. Especially, loss in the 800 MHz band is 4 dB and is relatively small in comparison with the maximum insertion loss in from 1.8 GHz to 2.5 GHz.

Thus, in the multi-band array antenna 100 of the first embodiment, a two-element array antenna and a three-element array antenna are realized for the four bands of the 800 MHz band, the 1.8 GHz band, the 2 GHz band and the 2.5 GHz band.

Figure 9:
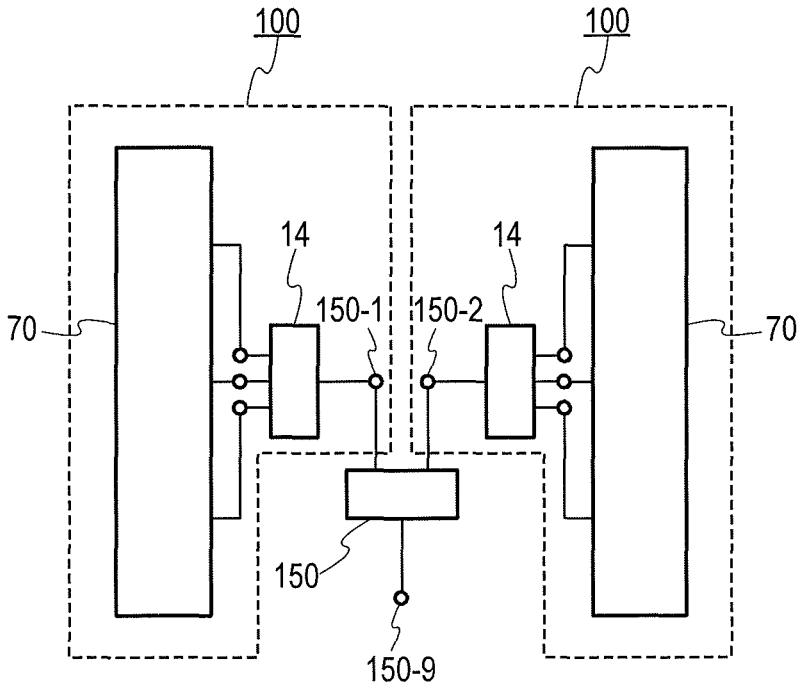
FIG. 9 shows a two-branch diversity configuration example.
Figure 10:
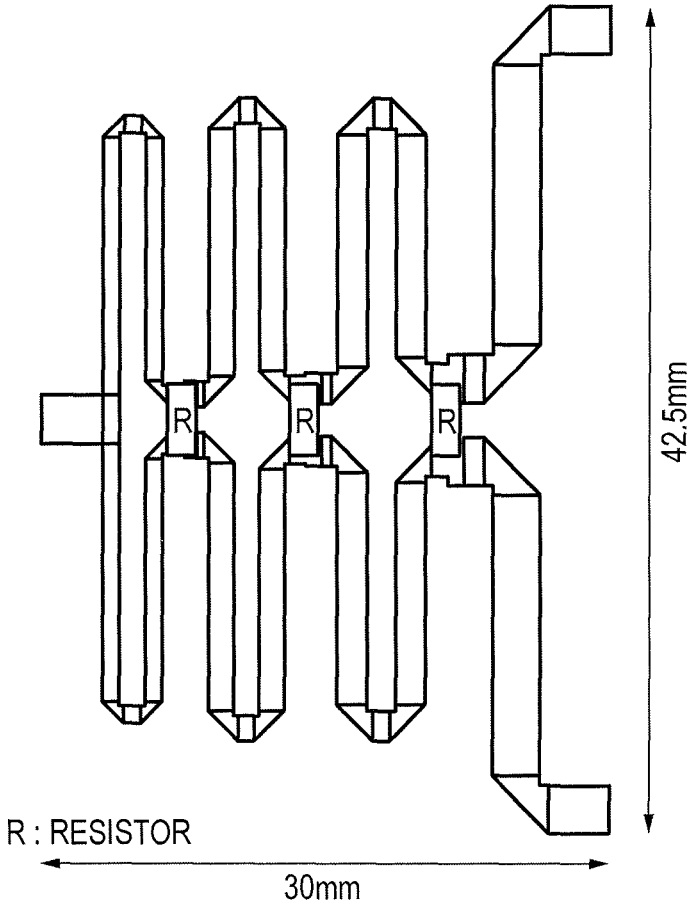
FIG. 10 shows a layout of a broadband two-way distribution circuit.

Further, a two-branch diversity antenna shown in FIG. 9 can be configured with two multi-band array antennas 100 and a broadband two-way distribution circuit 150. The broadband two-way distribution circuit 150 distributes input signals of from the 800 MHz band to the 2.5 GHz band with equal power and equal delay. A three-stage Wilkinson power distribution circuit is used as the broadband two-way distribution circuit 150. FIG. 10 shows a layout of the three-stage Wilkinson power distribution circuit. The printed-circuit board used is the same as the printed-circuit board used for the Wilkinson power distributor 14. The size is 4.25 cm in length and 3 cm in width. The designed operating frequency is 1.65 GHz which is in the middle between 800 MHz and 2.5 GHz. Input signals are distributed to ¼ wavelength lines each having a characteristic impedance of 86.8Ω, and each line is connected to a 91-Ω resistor. To the 91-Ω resistor, ¼ wavelength lines each having a characteristic impedance of 71.56Ω are connected, and each line is connected to a 240-Ω resistor. To the 240-Ω resistor, ¼ wavelength lines each having a characteristic impedance of 63.47Ω are connected, and each line is connected to a 200-Ω resistor. In the layout shown in FIG. 10, six ¼ wavelength lines are appropriately bent for space saving.

Figure 11:
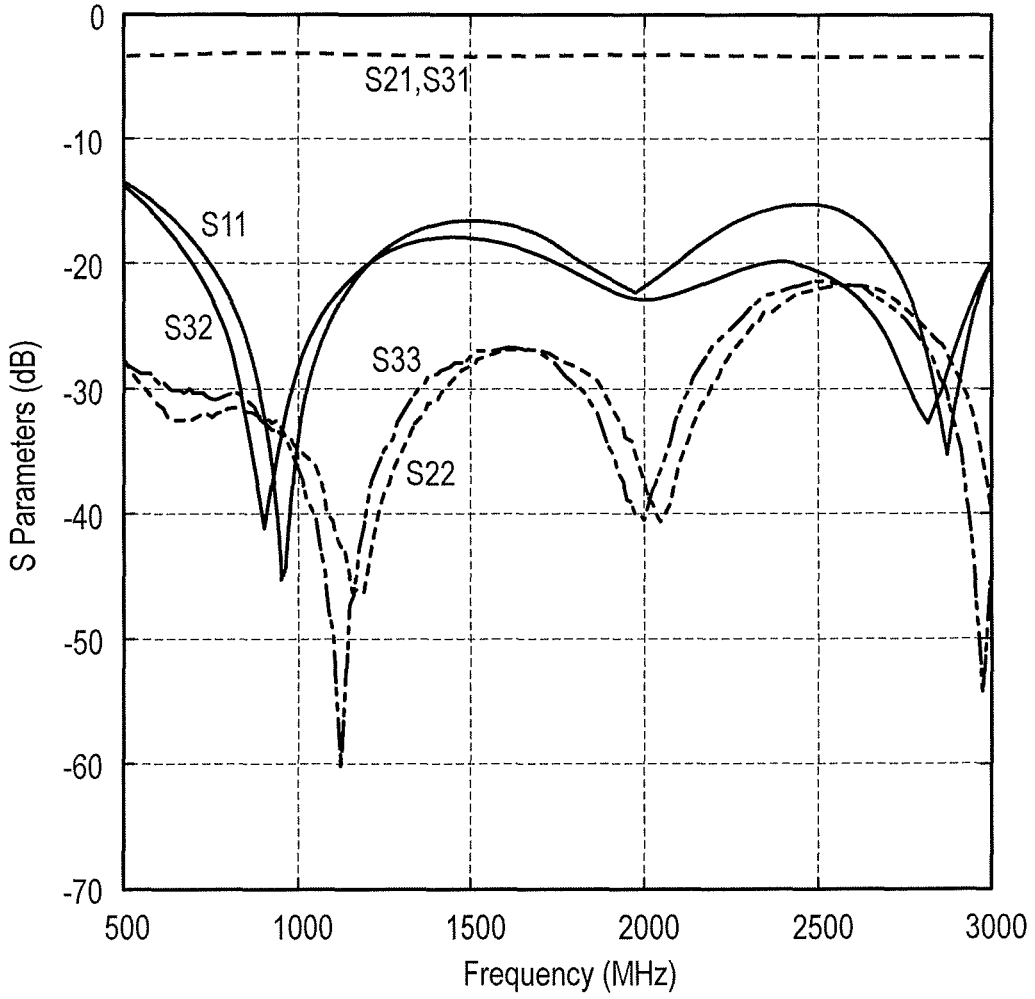
FIG. 11 shows frequency characteristics, reflection characteristics and isolation characteristics of the broadband two-way distribution circuit.

FIG. 11 shows calculation results of frequency characteristics of the broadband two-way distribution circuit 150. In FIG. 11, S11 indicates reflection characteristics at an input terminal 150-9; S22 indicates reflection characteristics at one output terminal 150-1; S33 indicates reflection characteristics at the other output terminal 150-2; S21 indicates characteristics of pass from the input terminal 150-9 to one multi-band array antenna 100; S31 indicates characteristics of pass from the input terminal 150-9 to the other multi-band array antenna 100; and S32 indicates isolation between the one output terminal 150-1 and the other output terminal 150-2. The broadband two-way distribution circuit 150 enables power distribution with a loss of about 3 dB for from the 800 MHz band to the 2.5 GHz band.

A broadband branch-line coupler can be adopted as the broadband two-way distribution circuit. By providing a broadband matching circuit on each terminal of the branch-line coupler, favorable distribution characteristics can be realized in a broadband. The above diversity antenna using the multi-band array antennas 100 of the first embodiment is a diversity circuit that combines two signals with equal delay. Therefore, since amplitudes and phases of signals received by the two multi-band array antennas 100 are combined with equal delay, characteristics corresponding to equal gain combining diversity can be expected. When a construction machine is in a weak electric field region such as a mountainous region, more secure wireless communication becomes possible by the diversity circuit.

Modification of First Embodiment

Figure 12:
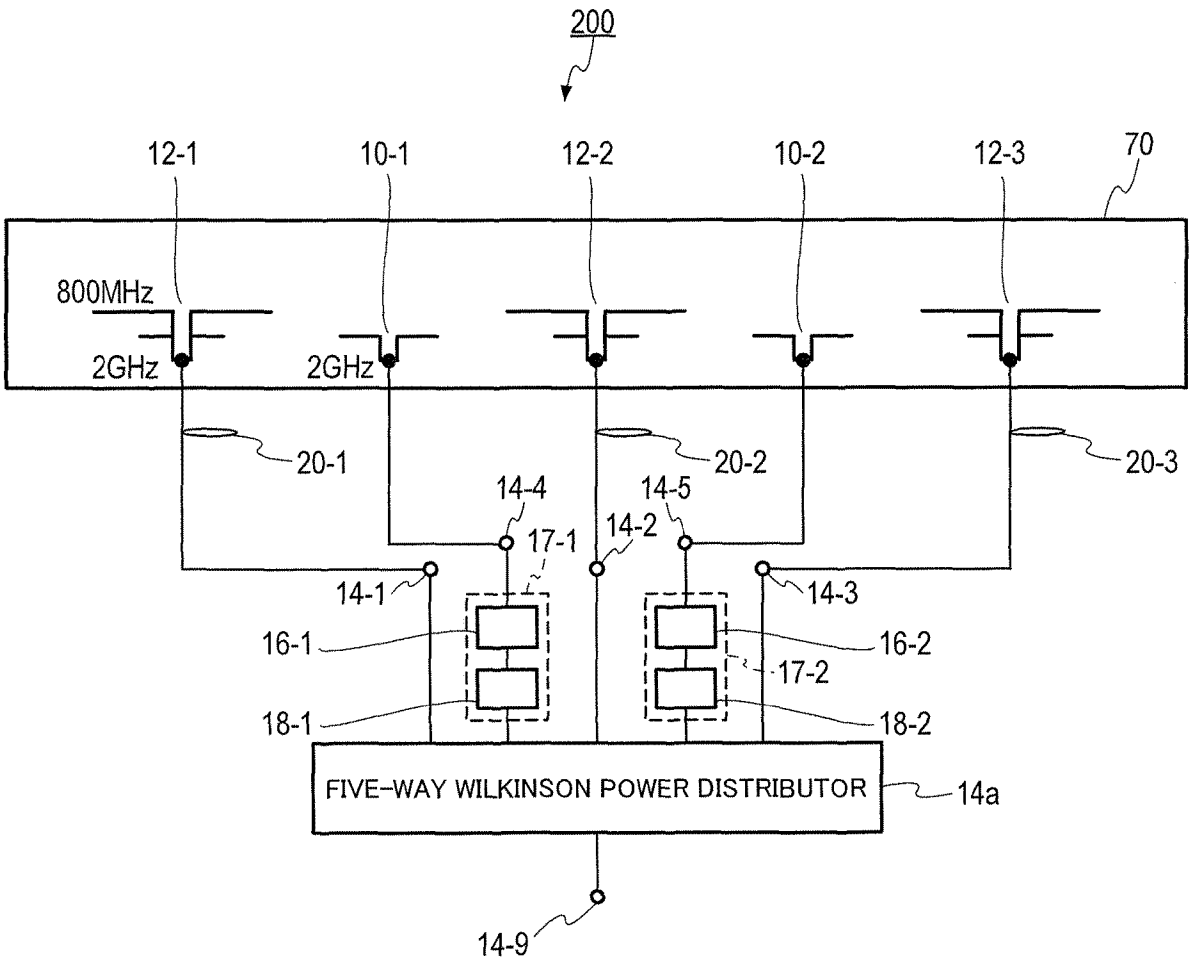
FIG. 12 shows a modification of the first embodiment.

A multi-band array antenna 200 shown in FIG. 12 is in a configuration in the case of p=1, q=2, m=2 and n=3. That is, the multi-band array antenna 200 comprises two first antenna elements 10-1 and 10-2 operating in one frequency band (2 GHz); three second antenna elements 12-1, 12-2 and 12-3 operating in each of two frequency bands (800 MHz and 2 GHz); one Wilkinson power distributor 14*a* having one input terminal 14-9 and five output terminals 14-1, 14-2, 14-3, 14-4 and 14-5; two filters 16-1 and 16-2; and two matching circuits 18-1 and 18-2.

The two first antenna elements 10-1 and 10-2 and the three second antenna elements 12-1, 12-2 and 12-3 are alternately arranged. One second antenna element 12-1 is connected to the first output terminal 14-1 among the five output terminals 14-1, 14-2, 14-3, 14-4 and 14-5 of the Wilkinson power distributor 14*a* via a delay circuit 20-1; one second antenna element 12-2 is connected to the second output terminal 14-2 via a delay circuit 20-2; and one second antenna element 12-3 is connected to the third output terminal 14-3 via a delay circuit 20-3. Further, one first antenna element 10-1 is connected to the fourth output terminal 14-4 of the Wilkinson power distributor 14*a* via a series-connection circuit portion 17-1 comprising one matching circuit 18-1 and one filter 16-1; and one first antenna element 10-2 is connected to the fifth output terminal 14-5 via a series-connection circuit portion 17-2 comprising one matching circuit 18-2 and one filter 16-2. The delay circuits 20-1, 20-2 and 20-3 give delay corresponding to delay by the series-connection circuit portions 17-1 and 17-2, to signals.

Each of the filters 16-1 and 16-2 attenuates a frequency band that is included in two frequency bands but is not included in one frequency band. Each matching circuit 18-*i* (i=1, 2) performs impedance matching between a filter 16-*i* to which the matching circuit 18-*i* is connected and the Wilkinson power distributor 14*a* in the frequency band attenuated by the filter 16-*i*. A series-connection circuit portion 17-*i* comprising a matching circuit 18-*i* and a filter 16-*i* is configured so that a branch portion of the Wilkinson power distributor 14*a* becomes an open end of a standing-wave in the frequency band attenuated by the filter 16-*i* comprised in this series-connection circuit portion 17-*i*.

The five-way Wilkinson power distributor 14*a* performs five-way distribution of input signals to ¼ wavelength lines each having a characteristic impedance of 111.8Ω. One end of a 50-Ω resistor is connected to an end of each ¼ wavelength line, and the other end of each resistor is grounded. By this configuration, it is possible to distribute power of input signals with equal delay.

Second Embodiment

Figure 13:
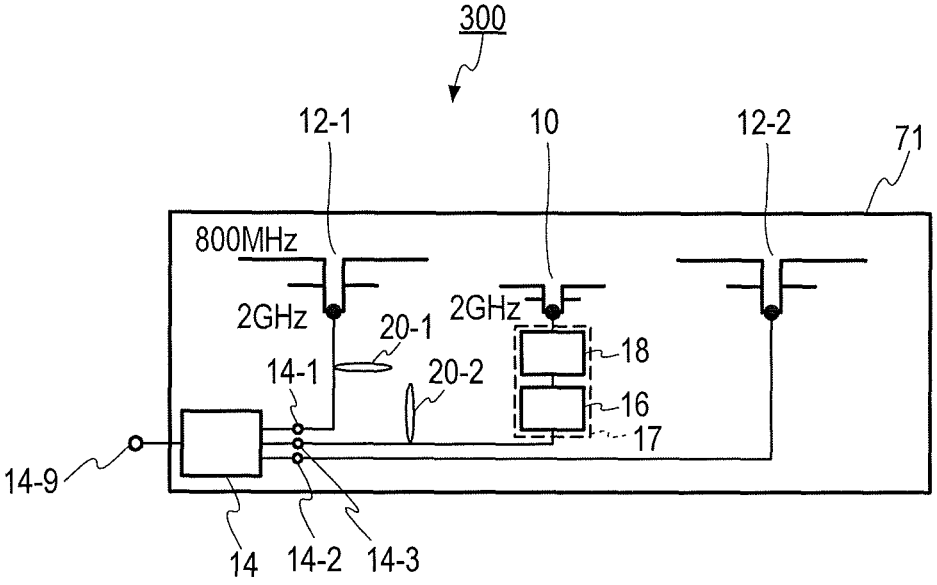
FIG. 13 shows a configuration of a second embodiment.

A multi-band array antenna 300 shown in FIG. 13 is in a configuration in the case of p=1, q=2, m=1 and n=2. That is, the multi-band array antenna 300 comprises one first antenna element 10 operating in one frequency band (2 GHz); two second antenna elements 12-1 and 12-2 operating in each of two frequency bands (800 MHz and 2 GHz); one Wilkinson power distributor 14 having one input terminal 14-9 and three output terminals 14-1, 14-2 and 14-3; one filter 16; and one matching circuit 18.

The one first antenna element 10 and the two second antenna elements 12-1 and 12-2 are alternately arranged. One second antenna element 12-1 is connected to the first output terminal 14-1 among the three output terminals 14-1, 14-2 and 14-3 of the Wilkinson power distributor 14 via a delay circuit 20-1, and one second antenna element 12-2 is connected to the second output terminal 14-2 via a 50-Ω line. Further, one first antenna element 10 is connected to the third output terminal 14-3 of the Wilkinson power distributor 14 via the series-connection circuit portion 17 comprising the one matching circuit 18 and the one filter 16, and a delay circuit 20-2. The delay circuits 20-1 and 20-2 give such delay that equals delay by a distance between the second output terminal and the second antenna element 12-2, to signals.

The filter 16 attenuates a frequency band that is included in two frequency bands but is not included in one frequency band. The matching circuit 18 performs impedance matching between the filter 16 to which the matching circuit 18 is connected and the Wilkinson power distributor 14 in the frequency band attenuated by the filter 16. The series-connection circuit portion 17 comprising the matching circuit 18 and the filter 16 is configured so that a branch portion of the Wilkinson power distributor 14 becomes an open end of a standing-wave in the frequency band attenuated by the filter 16 comprised in this series-connection circuit portion 17. In the second embodiment, a multi-band array antenna is formed on a single printed-circuit board 71.

Additionally, the present invention is not limited to the embodiments described above and can be appropriately modified within a range not departing from the gist of the present invention.

What is claimed is:

1. A multi-band array antenna comprising:

m first antenna elements each operating in p frequency bands;

n second antenna elements each operating in q frequency bands;

one Wilkinson power distributor having one input terminal and m+n output terminals;

one or more filters; and one or more matching circuits;

wherein the m and the n are positive integers satisfying $m+n \geq 3$ and any of $m=n+1$, $n=m+1$ and $m=n$;

the p and the q are positive integers satisfying $p \geq 1$, $p \geq 2$ and $q>p$;

the p frequency bands are included in the q frequency bands;

a number of the one or more filters is the m;

a number of the one or more matching circuits is the m;

the m first antenna elements and the n second antenna elements are alternately arranged;

each of the n second antenna elements is connected to a corresponding one of n output terminals among the m+n output terminals of the Wilkinson power distributor;

each of the m first antenna elements is connected to a corresponding one of m output terminals among the m+n output terminals of the Wilkinson power distributor via a series-connection circuit portion comprising a corresponding one of the m matching circuits and a corresponding one of the m filters;

each of the m filters attenuates a frequency band that is included in the q frequency bands but is not included in the p frequency bands;

as to each of the m matching circuits, one of the m matching circuits performs impedance matching between the Wilkinson power distributor and one of the m filters to which the same one of the m matching circuits is connected in a frequency band attenuated by the same one of the m filters; and the series-connection circuit portion has a configuration in which a branch portion of the Wilkinson power distributor becomes an open end in a frequency band attenuated by one of the m filters comprised in the series-connection circuit portion.

2. The multi-band array antenna according to claim 1, wherein a distance between one of the m first antenna element and one of the n second antenna element that are adjacent to each other is between 0.6 wavelengths and 1 wavelength including 0.6 wavelengths and excluding 1 wavelength, in each of the q frequency bands.

* * * * *